US009156158B2

(12) United States Patent
Freimuth

(10) Patent No.: US 9,156,158 B2
(45) Date of Patent: Oct. 13, 2015

(54) PRESS BRAKE TOOL CABINET WITH DRAWERS HAVING ROTATABLE FRONT PANELS

(71) Applicant: Versatility Tool Works & Manufacturing Company, Alsip, IL (US)

(72) Inventor: Edward Karl Freimuth, Palos Heights, IL (US)

( * ) Notice: Subject to any disclaimer, the term of this patent is extended or adjusted under 35 U.S.C. 154(b) by 0 days.

(21) Appl. No.: 14/257,826

(22) Filed: Apr. 21, 2014

(65) Prior Publication Data

US 2014/0225494 A1 Aug. 14, 2014

Related U.S. Application Data

(63) Continuation-in-part of application No. 12/272,491, filed on Nov. 17, 2008, now Pat. No. 8,696,074, and a continuation-in-part of application No. 14/075,591, filed on Nov. 8, 2013, now Pat. No. 8,870,308.

(60) Provisional application No. 61/904,485, filed on Nov. 15, 2013, provisional application No. 61/904,491, filed on Nov. 15, 2013.

(51) Int. Cl.

| | |
|---|---|
| ***A47B 88/00*** | (2006.01) |
| ***B25H 3/02*** | (2006.01) |
| ***E05B 1/00*** | (2006.01) |
| ***E05B 65/46*** | (2006.01) |

(52) U.S. Cl.

CPC ..... *B25H 3/028* (2013.01); *A47B 88/0044* (2013.01); *A47B 88/0051* (2013.01); *E05B 1/00* (2013.01); *E05B 65/462* (2013.01); *Y10T 29/49826* (2015.01); *Y10T 29/49876* (2015.01)

(58) Field of Classification Search

CPC ..... A47B 88/0044; A47B 2088/0074; A47B 88/0055; B62B 3/005

USPC ..... 312/348.1–348.4, 303, 302, 330.1, 312/208.1, 209; 403/205, 231, 403

See application file for complete search history.

(56) References Cited

U.S. PATENT DOCUMENTS

| | | | | | |
|---|---|---|---|---|---|
| 964,396 | A | * | 7/1910 | Warsop | 229/198.1 |
| 1,849,521 | A | * | 3/1932 | Haag | 312/234.5 |
| 2,199,102 | A | * | 4/1940 | Hough | 16/355 |
| 2,477,853 | A | * | 8/1949 | Baird | 312/213 |
| 3,759,600 | A | * | 9/1973 | MacDonald | 312/348.1 |
| 3,985,409 | A | * | 10/1976 | Kneier | 312/271 |
| 4,588,237 | A | * | 5/1986 | Marder | 312/209 |
| 4,887,874 | A | * | 12/1989 | Joffe | 312/258 |
| 4,923,261 | A | * | 5/1990 | Attardo | 312/303 |
| 5,011,241 | A | * | 4/1991 | Horton et al. | 312/330.1 |
| 5,388,032 | A | * | 2/1995 | Gill et al. | 700/17 |
| 5,587,877 | A | * | 12/1996 | Ryan et al. | 361/679.6 |
| 5,738,423 | A | * | 4/1998 | Alfaro | 312/290 |
| 5,826,719 | A | * | 10/1998 | Chen | 206/373 |

(Continued)

*Primary Examiner* — Janet M Wilkens

(74) *Attorney, Agent, or Firm* — Joseph Golant

(57) ABSTRACT

A press brake tool cabinet having multiple tool carrying drawers where the drawers are formed from a metal sheet base configured as two side panels separated by a bottom panel. A back panel is connected to the base, and a front panel having a first set of openings to receive snap fitted latches and a second set of openings for receiving strike plates is also connected to the base. Left and right strike plates are mounted to the base and the front panel is connected to one arm of a continuous hinge and a second arm of the continuous hinge is connected to the bottom panel. Lockable drawer slides connect the drawers to the cabinet.

16 Claims, 6 Drawing Sheets

(56) References Cited

U.S. PATENT DOCUMENTS 6,152,411 A * 11/2000 Lundstrom ..... 248/291.1
6,390,359 B1 * 5/2002 Lin ..... 229/198
8,162,330 B2 * 4/2012 Melkumyan et al. ..... 280/47.34
2006/0103278 A1 * 5/2006 Bousquet ..... 312/332.1
2006/0255703 A1 * 11/2006 Chang ..... 312/348.4
2007/0126325 A1 * 6/2007 Gorz et al. ..... 312/404
2009/0243450 A1 * 10/2009 Weng ..... 312/334.1
2012/0153791 A1 * 6/2012 Green ..... 312/333

* cited by examiner

PRESS BRAKE TOOL CABINET WITH DRAWERS HAVING ROTATABLE FRONT PANELS

PRIORITY REFERENCE

This application claims priority pursuant to 35 U.S.C. 120 from U.S. Provisional Application No. 61/904,485 filed Nov. 15, 2013, entitled "Tool Cabinet With Downward Opening Transparent Front Door", U.S. Provisional Application No. 61/904,491 filed Nov. 15, 2013, entitled "Press Brake Tool Cabinet Drawer Having Rotatable Front Panel", U.S. Non-Provisional application Ser. No. 12/272,491, filed on Nov. 17, 2008, entitled "Safety Lock System For Cabinet Drawers," now U.S. Pat. No. 8,696,074, and U.S. Non-Provisional application Ser. No. 14/075,591, filed on Nov. 8, 2013, entitled "Universal Safety Lock System For Tool Cabinets" which are all expressly incorporated herein by these references.

FIELD OF THE INVENTION

The present invention relates generally to a press brake tool cabinet drawers and, more particularly, to press brake tool cabinet drawers having rotatable or drop down front panels to enable quick, easy and safe removal of press brake tools from the drawers as well as quick, easy and safe return of such tools into the drawers.

BACKGROUND OF THE INVENTION

A press brake is a machine tool for bending sheet and plate material. The machine tool forms predetermined bends by clamping a workpiece between matching punch and die tools. The tools are heavy and bulky and are typically stored in tool cabinets. Changing dies is a time consuming and difficult task so that making the process easier, more efficient and safer is desirable. Typical press brake tool cabinet drawers have to be extended the tool lifted from the drawers. This is difficult and somewhat dangerous.

The invention discussed in connection with the described embodiments below address deficiencies of the press tool cabinet field. The features and advantages of the present invention will be explained in or become apparent from the following summary and detailed description of the preferred embodiment considered together with the accompanying drawings.

SUMMARY OF THE INVENTION

The press brake tool cabinet drawers of the present invention allows for quick, easy and efficient press brake tool removal from a cabinet drawer as well as tool return to the drawer by a user, and does so with a drawer that is compact and robust. The press brake tool cabinet drawers described in detail below are relatively low cost, easy to use and relatively easy to assemble.

Briefly summarized, the invention relates to a press brake tool cabinet including a press brake tool cabinet having multiple press brake tool carrying drawers, where each of the multiple press brake tool carrying drawers includes a drawer base formed into a drawer bottom panel and two drawer side panels, where each of the multiple press brake tool carrying drawers includes a drawer back panel connected to the drawer base, where each of the multiple press brake tool carrying drawers includes a drawer front panel, where each of the multiple press brake tool carrying drawers includes a hinge, the hinge being mounted to the front panel and to the bottom panel of the corresponding drawer to enable the front panel to rotate between a raised closed position and a lowered open position, and where each of the multiple press brake tool carrying drawers includes a fastener having a bolt connected to the front panel of the corresponding drawer and a strike plate mounted to the corresponding drawer base.

The invention also relates to a method for assembling the press brake tool cabinet with press brake tool carrying drawers, the drawers each having a flip down front panel, the method including the steps of forming a cabinet, bending a metal sheet base to form a bottom panel and two side panels for each press brake tool carrying drawer, connecting a back panel to the base of each press brake tool carrying drawer, attaching left and right strike plates to the base of each press brake tool carrying drawer, forming a front panel for each press brake tool carrying drawer, the front panel having openings for the strike plates and left and right latches, connecting the left and right latches to the front panel of each press brake tool carrying drawer, connecting a continuous hinge to the front panel of each press brake tool carrying drawer, and connecting the continuous hinge to the bottom panel of each press brake tool carrying drawer.

BRIEF DESCRIPTION OF THE DRAWINGS

For the purpose of facilitating an understanding of the invention, the accompanying drawings and detailed description illustrate the preferred embodiments thereof, from which the invention, its structures, its construction and operation, its processes, and many related advantages may be readily understood and appreciated.

DESCRIPTION OF THE PREFERRED EMBODIMENT

The following description is provided to enable those skilled in the art to make and use the described embodiment set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

Figure 1:
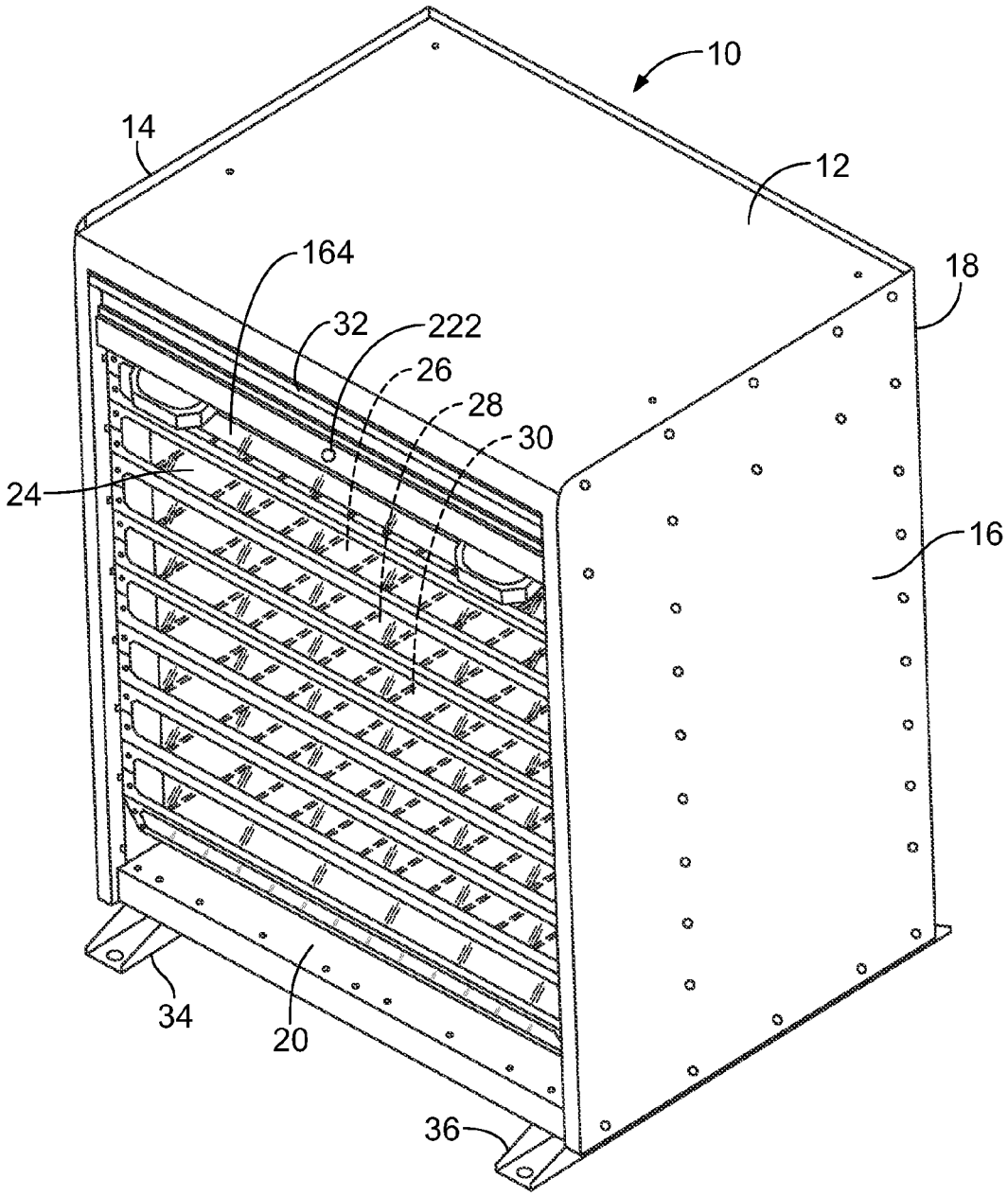
FIG. 1 is an isometric view of a press brake tool cabinet with several press brake tool drawers.

Referring now to FIG. 1 there is illustrated a press brake tool cabinet 10. The tool cabinet 10 includes a top panel 12, two side panels 14, 16, a rear panel 18, and a bottom panel 20. A transparent, downward opening door 24 is mounted at the front of the cabinet. Behind the door 24 are multiple press brake tool-receiving drawers, such as the drawers 26, 28, 30. Positioned above the closed door 24 and below the top panel 12 is a utility drawer 32 for accessories, such as measuring instruments. The tool cabinet 10 may also include two support brackets 34, 36 that may be used to mount the tool cabinet 10 to a factory or shop floor.

Figure 2:
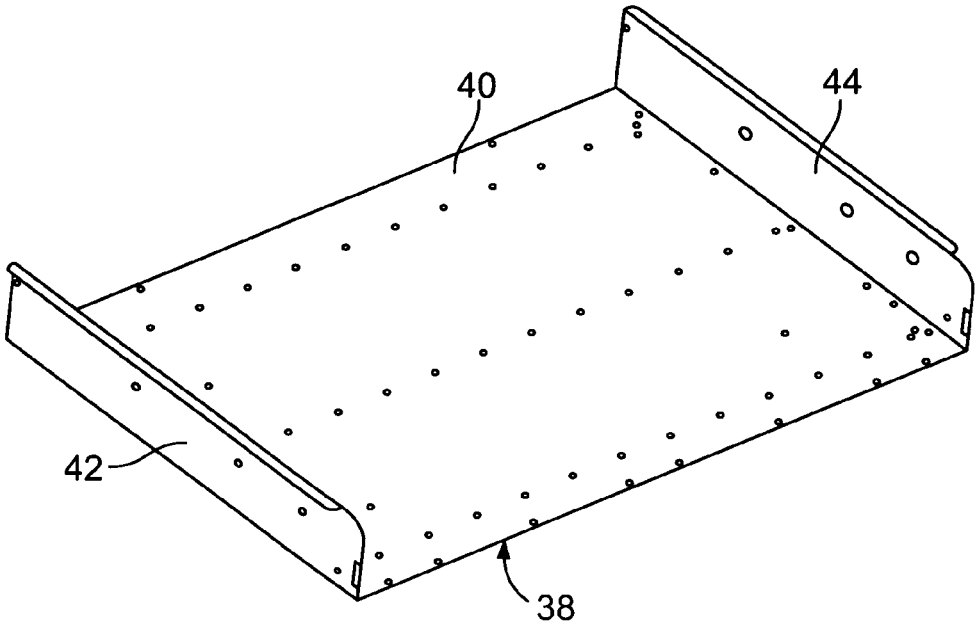
FIG. 2 is an isometric view of a drawer base.
Figure 3:
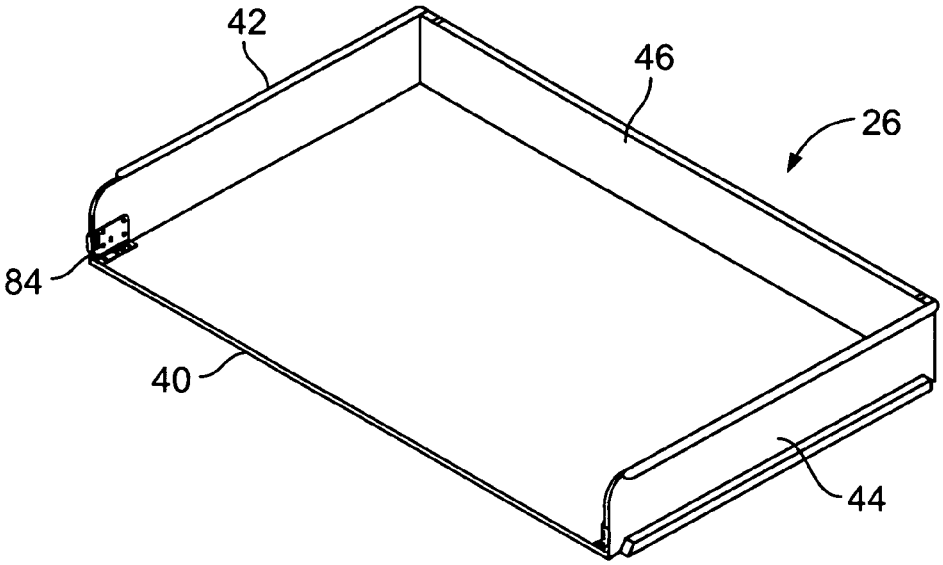
FIG. 3 is an isometric view of a partial press brake tool drawer.
Figure 4:
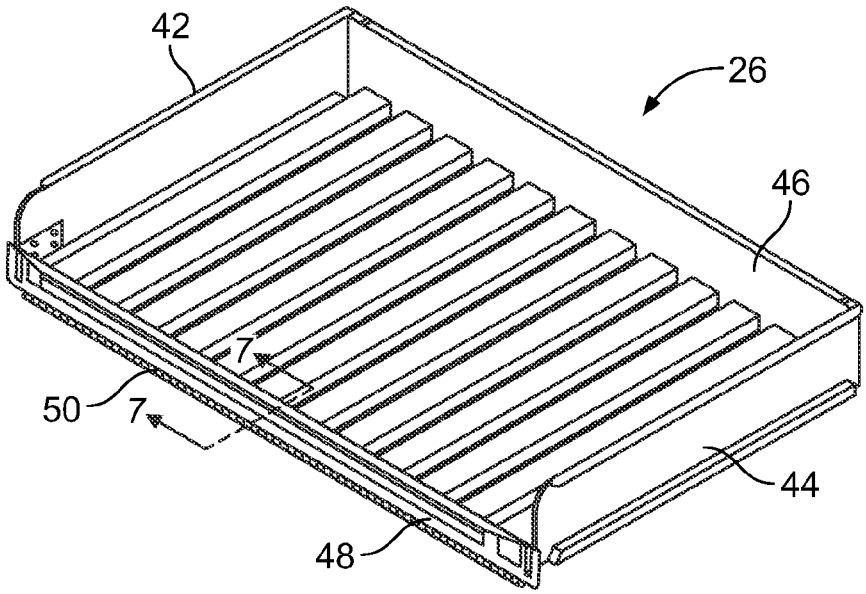
FIG. 4 is an isometric view of a press brake tool drawer with a front panel and a tool divider where the front panel is in a raised closed position.
Figure 5:
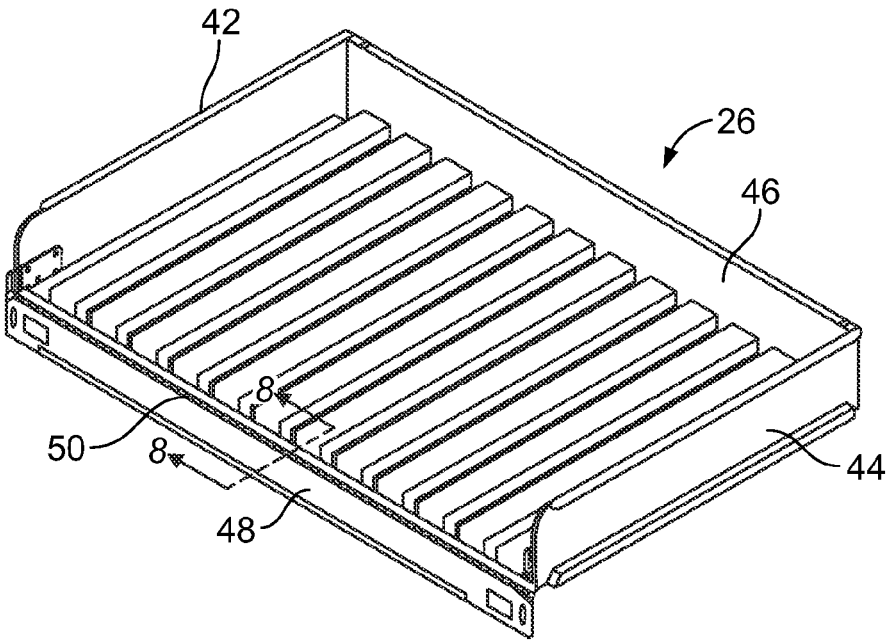
FIG. 5 is an isometric view of the tool drawer illustrated in FIG. 4, with the front panel in a lowered open position.

Each drawer, such as the drawer 26, which is illustrated partially formed in FIG. 2, and partially assembled in FIG. 3, includes a drawer base 38 formed into a bottom panel 40, and two side panels 42, 44. A back panel 46 is connected to the drawer base 38, and a front panel 48 is shown in FIG. 4. The front panel 48 is connected to a continuous hinge 50 and the hinge 50 is connected to the bottom panel 40. The hinge 50 allows the front panel 48 to rotate or drop down as illustrated in FIG. 5, so that heavy and bulky press brake tools may be more easily removed simply by sliding the tool out of the drawer. Sliding a press brake tool out of the drawer is much easier for a user than requiring him to lift the heavy tool upward out of the drawer. The same is true when the tool is returned back to the drawer. It is easier and safer to slide the tool back into the drawer than to lay or drop the tool into the drawer.

Each drawer, such as the partially formed drawer 26, FIG. 3, is formed from the metal sheet base 38, FIG. 2, that is bent to create the two side panels 42, 44 separated by the bottom panel 40. The back panel 46 is connected to the rear of the base 38. The front panel 48, FIG. 4, and the continuous hinge 50 are connected to the front of the base 38.

Figure 6:
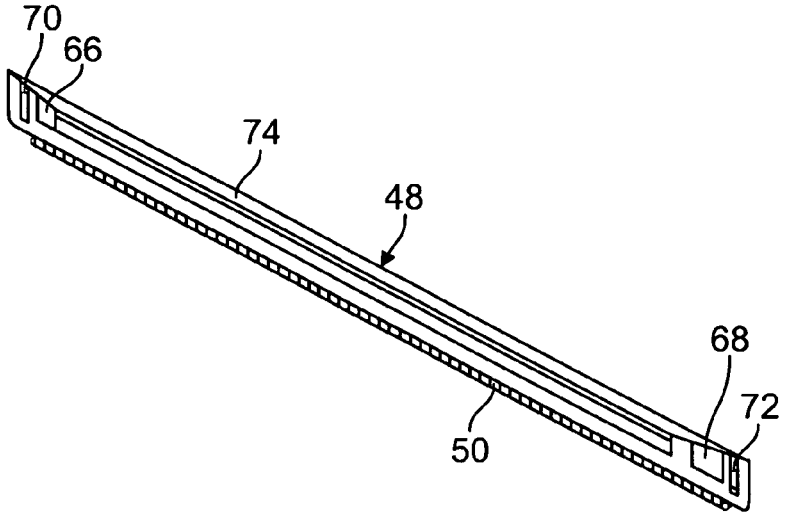
FIG. 6 is an isometric view of a front panel without fasters.
Figure 7:
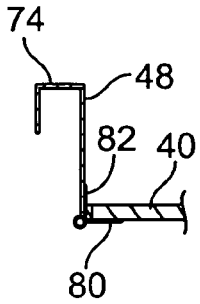
FIG. 7 is an enlarged sectional view taken along line 7-7 of FIG. 4, illustrating the front panel in a raised closed position.
Figure 8:
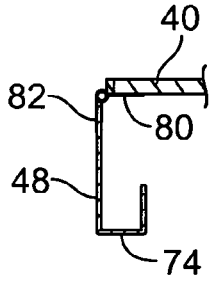
FIG. 8 is an enlarged sectional view taken along line 8-8 of FIG. 5, illustrating the front panel in its lowered open position.

The front panel 48, FIG. 6, includes two fastener openings 66, 68 and two strike plate openings 70, 72 outboard of the fastener openings as shown in FIG. 6. The strike plate openings 70, 72 receive strike plates that also form part of oppositely disposed fasteners or latches. The two latch openings 66, 68 accommodate snap-in latches that contain latch bolts. The front panel also includes an upper U-shaped portion 74, as shown in FIGS. 6-8. The fasteners and the strike plates are described in more detail below.

The front panel 48 and the hinge 50 are illustrated in a connected configuration in FIGS. 4-8. The continuous hinge 50 may be a pin and barrel (or knuckle) type having two extended arms 80, 82. The first arm 80 is connected the front panel 48 and the second arm 82 is connected to the bottom panel 40. Connections are made with any suitable fasteners well known in the field. In FIGS. 4 and 7, the front panel 48 is illustrated in an upright closed position relative to the bottom panel 40, while illustrated in FIGS. 5 and 8, the front panel 48 is illustrated in a lowered open position (about 180° removed from the upright position) relative to the bottom panel 40.

Figure 9:
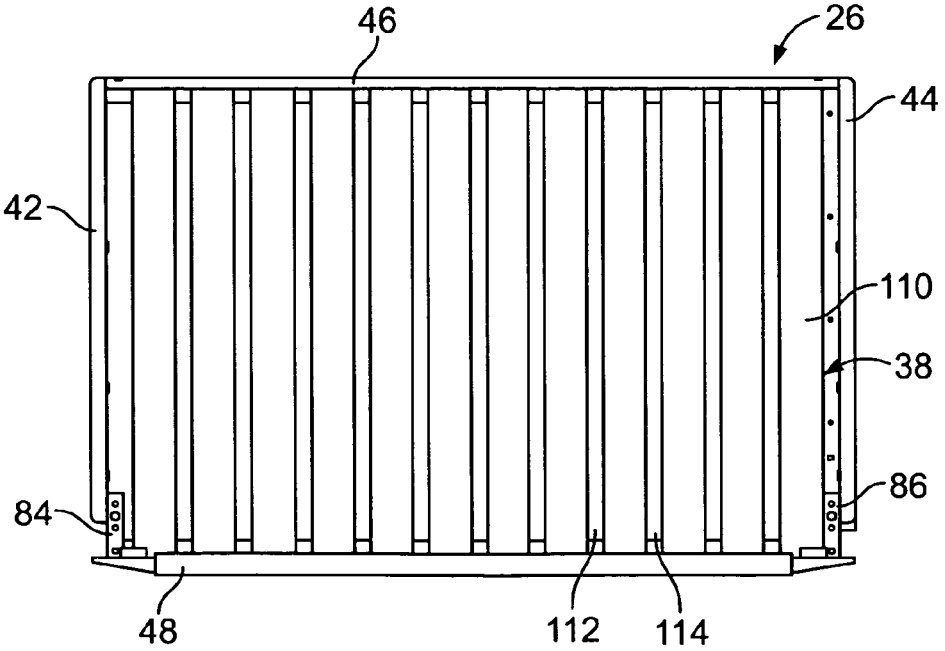
FIG. 9 is a top plan view of the drawer shown in FIG. 4, and illustrating left and right strike plates.
Figure 10:
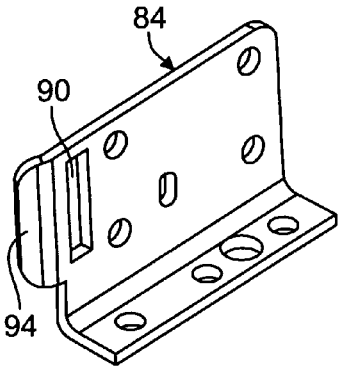
FIG. 10 is an enlarged isometric view of the left side strike plate.
Figure 12:
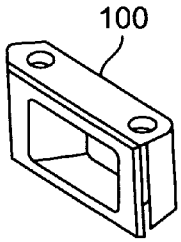
FIG. 12 is an isometric view of a latch fastener.
Figure 11:
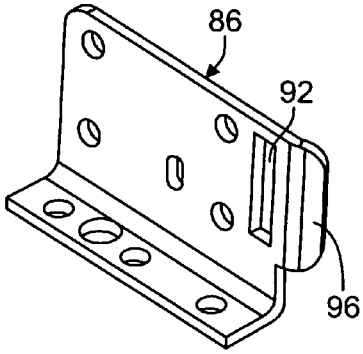
FIG. 11 is an enlarged isometric view of the right side strike plate.

Referring now to FIGS. 9-11, left and right L-shaped strike plates 84, 86 are mounted to the drawer base 38. Each strike plate 84, 86 includes a slot 90, 92, respectively, to receive a spring loaded bolt or bar from a fastener in the form of a latch, such as the latch 100, FIG. 12, that is snap-fitted into the fastener openings 66, 68, FIG. 6, of the front panel 48. Suitable snap-fitted latches may be acquired from EMKA of Velbert, Germany, model number 1091. The strike plates 84, 86, as shown in FIGS. 10 and 11, respectively, include flared lips 94, 96, which act as cams to the latch bolts as the front panel 48 is raised from its lowered position to its raised position. As illustrated in FIG. 9, a divider platform 110 may be placed or mounted to the drawer base 38 to organize and cradle press brake tools. It is noted that divider grooves, such as the divider grooves 112, 114, are oriented parallel to the side panels 42, 44, rather than the more usual perpendicular arrangement. Having the divider grooves extend from front to back rather than side to side allows for ease of press brake tool extraction from the drawer and return of the tools to the drawer after the front panel has been lowered.

Figure 13:
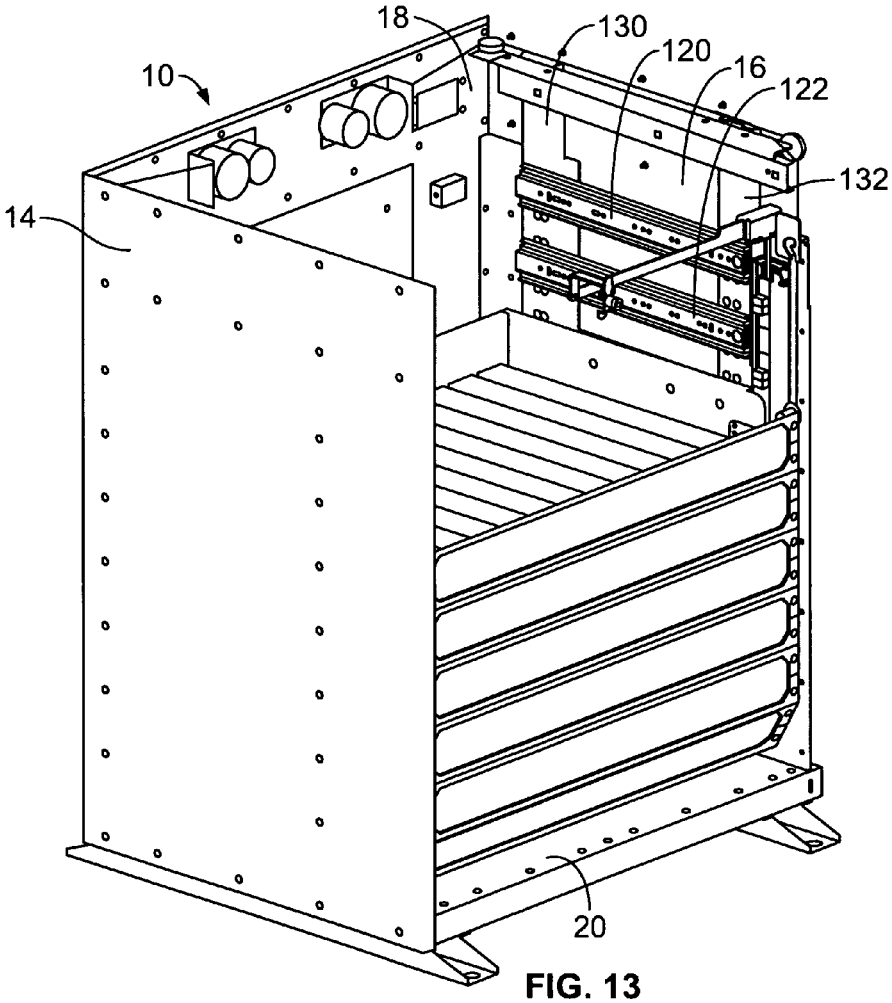
FIG. 13 is an isometric view of a portion of the press brake tool cabinet shown in FIG. 1, with drawer slides exposed.

Each of the drawer side panels 42, 44 are attached to drawer slides, such as the drawer slides 120, 122, illustrated in FIG. 13. The drawer slides are also attached to frame posts 130, 132 of the cabinet. To facilitate the removal of press brake tools and to enhance safety, the drawer slides 120, 122 are lockable so that a sliding tool does not drag a drawer further open then is intended by the user. Suitable heavy duty, lock in/lock out drawer slides may be acquired from ACCURIDE of Santa Fe Springs, Calif., model number 9308.

In the alternative, other latches and/or drawer slides may be used, if desired, and various drawer braces may be attached to the drawer base 38. Also the drawers may be formed differently, for example, each panel may be formed separately and fastened to the other panels.

It is noted that throughout this detailed disclosure, words such as "upper," "lower," "top," "bottom," "front," and "back," as well as like terms, refer to portions of the cabinet and drawers and their structures and elements as they are viewed in the drawings relative to other structures, elements or portions, or in relationship to the positions of the structures, elements and portions as they will typically be positioned in the finished cabinet when in use.

In operation of the flip down drawer, a user who wishes to remove a heavy and/or bulky press brake tool, for example, during a change over, opens the appropriate drawer, locks the drawer slides, retracts the latch bolts and lowers the front panel. Once the front panel is no longer latched it may be rotated to its lowered position. After the front panel is lowered the press brake tool may be slid away from the drawer and removed by the user using both hands if necessary because of tool's weight. After the press tool is installed in a machine tool, the user may close the drawer's front panel, which will latch automatically when the front panel is returned to its raised position. Because the drawer slides are locked the drawer will not move outward when the tool is pulled out or move inward when the front panel is raised to the closed position. When the user wishes to return the press brake tool, the process with the drawer is repeated. The drawer is extended, the drawer slides are locked, the latch bolts are retracted and the front panel is lowered. The user is then able to use both hands to return the press brake tool to the proper divider location.

Figure 14:
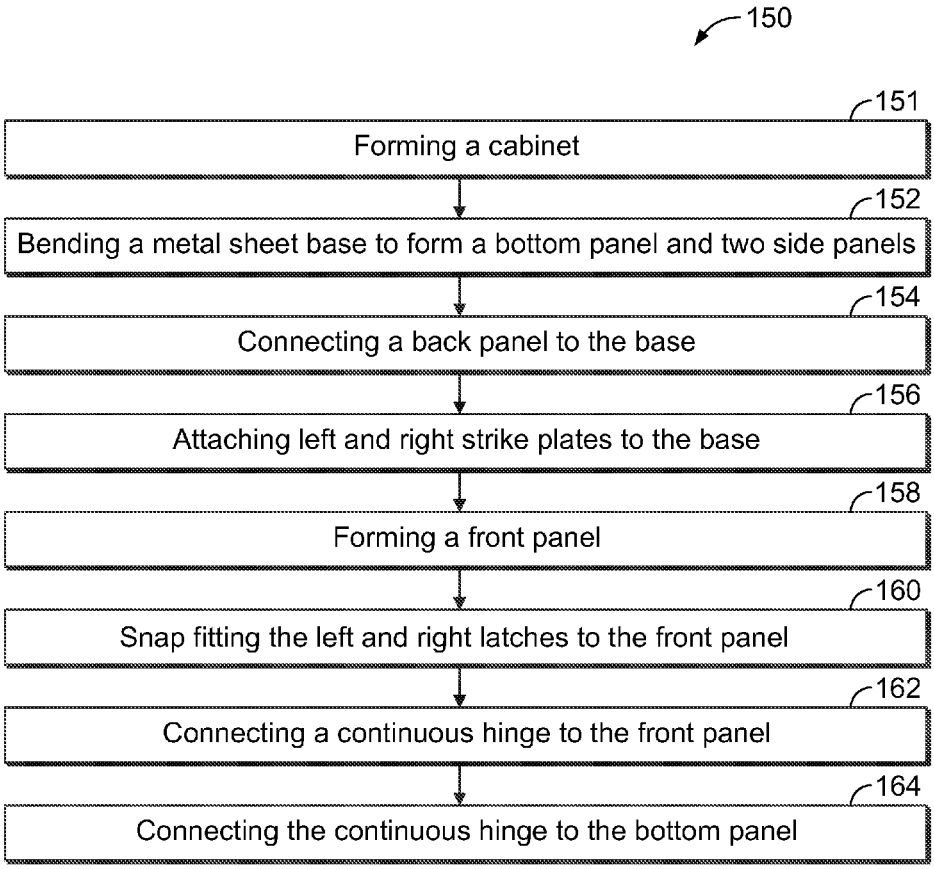
FIG. 14 is a flow chart of a method of assembling the press brake tool drawer.

The present invention also includes a method 150, FIG. 14, for assembling a press brake tool cabinet with press brake tool carrying drawers, the drawers each having a flip down front panel. The method includes the steps of forming a cabinet 151, bending a metal sheet base to form a bottom panel and two side panels 152 for each press brake tool carrying drawer, connecting a back panel to the base 154 of each press brake tool carrying drawer, attaching left and right strike plates to the base 156 of each press brake tool carrying drawer, forming a front panel 158 for each press brake tool carrying drawer, each front panel having openings for the strike plates and left and right latches, snap fitting the left and right latches to each of the front panels 160, connecting a continuous hinge to each of the front panels 162, and connecting the continuous hinge to each of the corresponding bottom panels 164. The method may also include the steps of snap fitting the latches in the openings of each front panel, connecting drawer slides to the cabinet and the drawers to enable each drawer to be extended from the cabinet, and placing a press brake tool divider on each bottom panel of each drawer where each divider includes grooves extending parallel to the side panels.

It may now be appreciated that the press brake tool cabinet includes drawers that are compact and robust, but easy to use so that removing and returning press brake tools from and to the drawers are simple and safe. The drawers are also easy and inexpensive to form and assemble.

From the foregoing, it can be seen that there has been provided features for an improved press brake tool cabinet with multiple drawers and a disclosure for the drawer apparatus and the method of assembling the drawer. While particular embodiment of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent patent claims when viewed in their proper perspective based on the prior art.

The invention claimed is:

1. A press brake tool cabinet comprising:

a cabinet top panel;

two cabinet side panels;

a cabinet rear panel;

a cabinet bottom panel;

a plurality of drawers, each drawer of the plurality of drawers for carrying press brake tools;

each drawer of the plurality of press brake tool drawers includes a drawer bottom panel, a drawer back panel, two drawer side panels and a drawer front panel, the drawer front panel having two spaced apart first openings and two spaced apart second openings wherein each of the first openings enable receipt of a fastener, and each of the second openings enable receipt of a strike plate lip, and the drawer bottom panel extending from the drawer back panel to the drawer front panel and from one side panel to the other side panel;

a hinge mounted to both the drawer front panel and to the drawer bottom panel of each drawer of the plurality of drawers to enable the front panel to rotate between a raised closed position and a lowered open position;

two fasteners, each of the fasteners mounted in one of the first openings in the front panel of each drawer of the plurality of drawers; and two strike plates, each of the strike plates mounted to one of the drawer side panels of each drawer of the plurality of drawers, and each strike plate having a lip for extending through one of the second openings in the drawer front panel, the fasteners and strike plates for fastening the drawer front panel to the drawer side panels, wherein each drawer of the plurality of drawers is enabled to extend from the cabinet when the drawer front panel is fastened to the drawer side panels in the raised closed position and thereafter the drawer front panel is enabled to disengage from the drawer side panels.

2. The press brake tool cabinet as claimed in claim 1, wherein:

the hinge is a continuous hinge having a first arm connected to the drawer front panel of each drawer of the plurality of drawers and a second arm connected to the drawer bottom panel.

3. The press brake tool cabinet as claimed in claim 1, wherein:

the hinge rotates about 180°.

4. The press brake tool cabinet as claimed in claim 1, wherein:

the second openings of the drawer front panel are spaced outboard of the first openings.

5. The press brake tool cabinet as claimed in claim 4, wherein:

the two fasteners snap into the two first openings in the drawer front panel.

6. The press brake tool cabinet as claimed in claim 5, wherein:

the two strike plates are each mounted to the drawer bottom panel and to one of the two drawer side panels of each drawer of the plurality of drawers.

7. The press brake tool cabinet as claimed in claim 1, including:

a divider platform having grooves, the divider platform being mounted in each drawer of the plurality of drawers, wherein all of the grooves of the divider platform extend parallel to the drawer side panels.

8. The press brake tool cabinet as claimed in claim 1, wherein:

each drawer of the plurality of drawers is connected to a pair of drawer slides mounted to the cabinet to enable each of the drawers to extend from the cabinet; and each of the drawer slides is lockable when extended.

9. The press brake tool cabinet as claimed in claim 1, wherein:

the hinge is a continuous hinge having a first arm connected to the front panel and a second arm connected to the drawer bottom panel of each drawer of the plurality of drawers; and the arms of the hinge rotate about 180°.

10. The press brake tool cabinet as claimed in claim 1, wherein:

each of the strike plates is L-shaped and is mounted to the drawer bottom panel and to one of the two drawer side panels.

11. The press brake tool cabinet as claimed in claim 1, wherein:

the drawer front panel includes an upper U-shaped portion.

12. The press brake tool cabinet as claimed in claim 1, including:

drawer slides connected to each drawer; and a divider platform mounted to each drawer base; and wherein the hinge is a continuous hinge having a first arm connected to the drawer front panel of each drawer and a second arm connected to the drawer bottom panel;

the arms of the hinge rotates about 180°;

the second openings are outboard of the first openings;

each drawer is connected to oppositely disposed drawer slides and the drawer slides are mounted to cabinet frame posts;

each of the drawer slides is lockable when extended;

each of strike plates is L-shaped and is mounted to both of the drawer bottom panel and to one of the drawer side panels; and the divider platform includes only parallel disposed grooves extending parallel to the drawer side panels.

13. A method for assembling a press brake tool cabinet with press brake tool drawers, each drawer having a flip down front panel comprising the steps of:

forming a cabinet with four frame posts;

forming each press brake tool drawer by bending a metal sheet base to form a bottom panel and two side panels;

connecting a back panel to the base of each of the press brake tool drawers;

attaching left and right strike plates to the bottom panel and the side panels of each of the press brake tool drawers;

forming a front panel for each of the press brake tool drawers, the front panel having two openings for the strike plates and two openings for left and right latches;

connecting left and right latches in the latch openings of the front panel of each of the press brake tool drawers;

mounting one arm of a continuous hinge to the front panel of each of the press brake tool drawers; and mounting a second arm of the continuous hinge to the drawer bottom panel of each of the press brake tool drawers.

14. The method claimed in claim 13, wherein:

each strike plate includes a lip that extends through a strike plate opening.

15. The method claimed in claim 14, including the step of:

connecting drawer slides to the four posts and to each of the press brake tool drawers to enable each of the press brake tool drawers to be extended from the cabinet.

16. The method claimed in claim 15, including the step of:

placing a press brake tool divider on the bottom panel of each of the press brake tool drawers wherein the divider includes grooves all of which extend parallel to the drawer side panels.

* * * * *